US005979000A

United States Patent [19]

Gansow

[11] Patent Number: 5,979,000

[45] Date of Patent: Nov. 9, 1999

[54] MOTOR-DRIVEN PLATE WITH CLEANING TOOLS FOR FLOOR MACHINE

[75] Inventor: Peter Gansow, Hagen, Germany

[73] Assignee: Gansow GmbH + Co. KG Maschinenbau, Bergkamen, Germany

[21] Appl. No.: 09/038,533

[22] Filed: Mar. 11, 1998

[30] Foreign Application Priority Data

Mar. 20, 1997 [DE] Germany ..... 197 11 552

[51] Int. Cl.[6] ..... A47L 11/00

[52] U.S. Cl. ..... 15/49.1; 15/50.1; 15/52; 15/98; 451/353; 451/271

[58] Field of Search ..... 15/52, 49.1, 50.1, 15/78, 87, 98; 451/271, 350, 353, 37

[56] References Cited

U.S. PATENT DOCUMENTS

| | | | |
|---|---|---|---|
| 1,854,638 | 4/1932 | Woods | 15/50.1 |
| 2,917,760 | 12/1959 | Baxter | 15/49.1 |
| 3,401,416 | 9/1968 | Ziegler | 451/353 |
| 4,319,434 | 3/1982 | Brejcha | 15/49.1 |
| 5,548,860 | 8/1996 | Weltikol et al. | 15/49.1 |

FOREIGN PATENT DOCUMENTS

| | | |
|---|---|---|
| 0403077A1 | 12/1990 | European Pat. Off. . |
| 195 22 019 | 12/1996 | Germany . |
| 2262219A | 6/1993 | United Kingdom . |

*Primary Examiner*—Robert J. Warden, Sr.
*Assistant Examiner*—Kaj K. Olsen
*Attorney, Agent, or Firm*—Herbert Dubno; Andrew Wilford

[57] ABSTRACT

A head for a floor cleaning machine has a plate rotatable about an upright plate axis and formed offset therefrom with a plurality of downwardly open pockets, respective bearings seated in the pockets, and respective rods rotatable in the bearings about respective tool axes intersecting and forming a very small acute angle with the plate axis. Respective mounting sleeves fixed on the rods are each formed with a plurality of axially downwardly extending and radially deflectable retaining fingers each in turn having an outwardly directed barb and respective tool elements each have an upper side turned toward the plate and an opposite lower side and are each formed with a central throughgoing hole in turn formed with a downwardly directed shoulder and receiving the respective mounting sleeve with the respective barbs engaged over the shoulder and retaining the respective element on the respective mounting sleeve. Respective seal assemblies on the plate and elements annularly surround each rod. Respective caps hermetically close the holes in the elements at the respective lower sides.

11 Claims, 1 Drawing Sheet

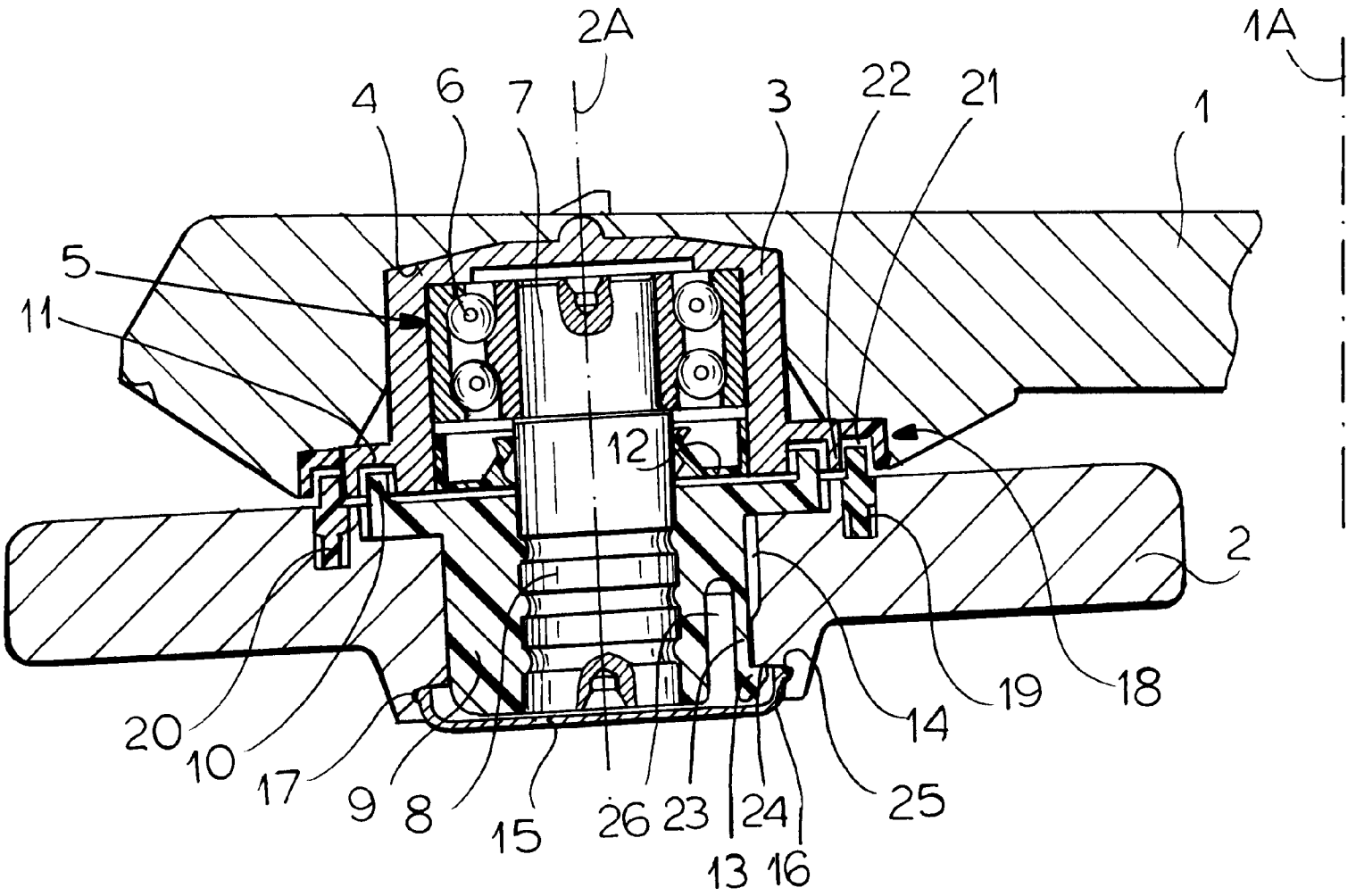
1A
1
2
18
19
21
22
14
25
3
16
13
24
23
26
12
2A
7
15
6
8
4
9
17
10
20
5
11

MOTOR-DRIVEN PLATE WITH CLEANING TOOLS FOR FLOOR MACHINE

FIELD OF THE INVENTION

The present invention relates to a floor-cleaning or polishing machine. More particularly this invention concerns a motor-driven plate with cleaning tools for such a machine.

BACKGROUND OF THE INVENTION

As described in commonly owned German patent document 195 22 019 a head for a floor cleaning machine has a plate rotatable about an upright plate axis and formed offset therefrom with a plurality of downwardly open pockets, respective bearings seated in the pockets, and respective rods rotatable in the bearings about respective tool axes intersecting and forming a very small acute angle with the plate axis. Respective mounting sleeves fixed on the rods are each formed with a plurality of axially downwardly extending and radially deflectable retaining fingers each in turn having an outwardly directed barb. Respective tool elements each have an upper side turned toward the plate and an opposite lower side and are each formed with a central throughgoing hole in turn formed with a downwardly directed shoulder and receiving the respective mounting sleeve with the respective barbs engaged over the shoulder and retaining the respective element on the respective mounting sleeve. Respective seal assemblies on the plate and elements annularly surround each rod.

In such an arrangement it is necessary to periodically replace the tool elements, which can be brushes, polishing disks, or the like. This is done by inverting the tool and pushing in the deflectable fingers so that the tools can be pulled off the rods. Such an operation is carried out in the field normally by the janitorial staff using the equipment.

After some use of the floor machine, however, it is likely that wax, for instance, will fill the hole in the bottom of each tool, packing it tight with a relatively hard substance. Such fouling makes it very difficult to remove the tools, as the retaining fingers have to be pushed inward against this mass. Thus the person changing the tools must clean out the centers of the tools before removing them, making the changeover operation fairly onerous.

OBJECTS OF THE INVENTION

It is therefore an object of the present invention to provide an improved head for a floor-cleaning machine.

Another object is the provision of such an improved head for a floor-cleaning machine which overcomes the above-given disadvantages, that is whose tools are easy to remove, even after protracted use of the machine.

SUMMARY OF THE INVENTION

A head for a floor cleaning machine has according to the invention a plate rotatable about an upright plate axis and formed offset therefrom with a plurality of downwardly open pockets, respective bearings seated in the pockets, and respective rods rotatable in the bearings about respective tool axes intersecting and forming a very small acute angle with the plate axis. Respective mounting sleeves fixed on the rods are each formed with a plurality of axially downwardly extending and radially deflectable retaining fingers each in turn having an outwardly directed barb and respective tool elements each have an upper side turned toward the plate and an opposite lower side and are each formed with a central throughgoing hole in turn formed with a downwardly directed shoulder and receiving the respective mounting sleeve with the respective barbs engaged over the shoulder and retaining the respective element on the respective mounting sleeve. Respective seal assemblies on the plate and elements annularly surround each rod. According to the invention respective caps hermetically close the holes in the elements at the respective lower sides.

Thus with this system to change the elements the caps are popped out and then the fingers are deflected inward. The step of removing the caps is inconsequential compared to the work needed with the prior-art systems to clean out the material filling the holes in the tools. Since any forces applied to the caps during normal use will be in a direction tending to push them into place, they can be a simple snap fit so that they are of simple construction and do not add significantly to the cost of the machine.

The seal assemblies in accordance with the invention each include a labyrinth seal engaged between the plate and the bearing assembly. In addition each bearing assembly includes a downwardly directed cup fitted in the respective pocket and forming part of the labyrinth seal and the seal assemblies each further include a flexible seal ring bearing radially outwardly of the respective tool axis on the cup and radially inwardly of the respective tool axis on the respective pin.

According to another feature of the invention each seal assembly further comprises an annular ring centered on the respective tool axis and set in and projecting upwardly from the upper side of the respective element. The plate is formed around each ring axis with a downwardly open annular groove loosely receiving the respective ring. Each downwardly open groove has an inner flank defined by the respective cup. Such a second labyrinth seal radially outside the first-mentioned one effectively prevents liquid and solid material from getting to the bearing.

Each hole according to the invention is formed below the shoulder with a radially inwardly open annular groove and each cap is formed with a radially outwardly projecting annularly continuous rim snugly fitted in the respective groove. Furthermore each cap has an axially upwardly extending annular rim fitted in the respective hole and spaced radially outward from the respective barbs. This leaves clearance for removal and insertion of the caps without interfering with the mount of the tool on the plate.

BRIEF DESCRIPTION OF THE DRAWING

The above and other objects, features, and advantages will become more readily apparent from the following description, reference being made to the accompanying drawing whose sole FIGURE is a vertical section through a portion of a head of a floor machine according to the invention.

SPECIFIC DESCRIPTION

As seen in the drawing a floor machine has a basically circular plate 1 rotatable about a vertical axis 1A and carrying a plurality of floor tools 2, shown only to the extent of the support base of such tool, that are rotatable about respective axes 2A that form a very small acute angle with and intersect the axis 1A well below the structure shown in the view. The plate 1 is formed at each tool 2 with a downwardly open and upwardly closed cylindrical pocket 4 fitted with a respective downwardly open liner cup 3 in turn holding a bearing 5 having balls 6. The outer race of the bearing 5 bears on the inner surface of the cup and its inner race on the outer surface of mounting rod 7 having an annularly grooved lower end 8 to which is fitted a plastic mounting sleeve 9.

The sleeve 9 is formed with an upwardly projecting annular ridge 10 that fits loosely in a complementary square-section downwardly open groove 11 formed in the cup 3 to form therewith a labyrinth seal. An elastomeric ring 19 fitted in an upwardly open groove 20 centered on the axis 2A similarly projects upward beyond the upper side or face of the tool disk 2 and is engaged loosely in another groove 21 formed between an outer edge 22 of the cup 3 and an L-section elastomeric ring 18 lining the top and outer surface of this groove 21, to form an outer labyrinth seal. In addition a gland-type seal 12 is provided having an outer lip engaged against an inner surface of the cup 3 and an inner lip bearing elastically on an outer surface of the rod 7. Thus there are three annular seals between the tool 2 and the plate 1 to prevent fouling of the bearing 5.

The sleeve 9 is fitted into a hole 14 in the tool 2 and is formed with axially downwardly projecting fingers 23 having barbed lower ends 13 that engage a downwardly directed shoulder 24 of this hole 14. These fingers 23 can be deflected radially inward to move the barbs 13 clear of the shoulder 24 and thereby allow the tool 2 to be pulled down off the sleeve 9.

According to the invention a flat metal cap 15 has a rim 16 formed with an outwardly projecting annular ridge 17 received in an inwardly open annular groove 25 formed in the widened lower end portion of the cylindrical hole 14 below the shoulder 24. Thus this cap 15 can be snap fitted to this hole 14 to close its lower end hermetically, thereby preventing the entry of material into the space 26 formed between the fingers 13 and the body of the sleeve 9. The rim 16 is spaced radially outward of the barbs 13 so that installation and removal of this cap 15 do not loosen these barbs 13.

I claim:

1. A head for a floor cleaning machine, the head comprising:

a plate rotatable about an upright plate axis and formed offset therefrom with a downwardly open pocket;

a bearing seated in the pocket;

a rod rotatable in the bearing about a tool axis;

a mounting sleeve fixed on the rod and formed with a plurality of axially downwardly extending and radially deflectable retaining fingers each in turn having an outwardly directed barb;

a tool element having an upper side turned toward the plate and an opposite lower side and formed with a central throughgoing hole in turn formed with a downwardly directed shoulder and receiving the mounting sleeve with the barbs engaged over the shoulder and retaining the element on the mounting sleeve;

a seal assembly on the plate and tool element annularly surrounding the rod; and a cap hermetically closing the hole in the tool element at the lower side.

2. The cleaning-machine head defined in claim 1 wherein the seal assembly includes a labyrinth seal engaged between the plate and the bearing.

3. The cleaning-machine head defined in claim 2 wherein the bearing includes a downwardly directed cup fitted in the pocket and forming part of the labyrinth seal.

4. The cleaning-machine head defined in claim 3 wherein the seal assembly further includes a flexible seal ring bearing radially outwardly of the tool axis on the cup and radially inwardly of the tool axis on the pin.

5. The cleaning-machine head defined in claim 4 wherein the seal assembly further comprises an annular ring centered on the axis and set in and projecting upwardly from the upper side of the element, the plate being formed around the ring axis with a downwardly open annular groove loosely receiving the ring.

6. The cleaning-machine head defined in claim 5 wherein the downwardly open annual groove has an inner flank defined by the cup.

7. The cleaning-machine head defined in claim 1 wherein the hole is formed below the shoulder with a radially inwardly open annular groove and the cap is formed with a radially outwardly projecting annularly continuous rim snugly fitted in the groove.

8. The cleaning-machine head defined in claim 1 wherein the cap has an axially upwardly extending annular rim fitted in the hole and spaced radially outward from the barbs.

9. The cleaning-machine head defined in claim 1 wherein the mounting sleeve is plastic and the cap is metal.

10. The cleaning-machine head defined in claim 1 wherein the tool axis intersects and forms a very small acute angle with the plate axis.

11. A head for a floor cleaning machine, the head comprising:

a plate rotatable about an upright plate axis and formed offset therefrom with a downwardly open pocket;

a downwardly open cup seated in the pocket;

a bearing seated in the cup;

a rod rotatable in the bearing about a tool axis intersecting and forming a very small acute angle with the plate axis;

a mounting sleeve fixed on the rod and formed with a plurality of axially downwardly extending and radially deflectable retaining fingers each in turn having an outwardly directed barb;

a tool element having an upper side turned toward the plate and an opposite lower side and formed with a central throughgoing hole in turn formed with a downwardly directed shoulder and receiving the mounting sleeve with the barbs engaged over the shoulder and retaining the element on the mounting sleeve;

a labyrinth seal engaged between the plate and the tool element;

a seal ring having an inner lip bearing against the rod and an outer lip bearing against the cup; and a cap hermetically closing the hole in the tool element at the lower side.

* * * * *